US010159370B1

(12) United States Patent
Bisbal

(10) Patent No.: US 10,159,370 B1
(45) Date of Patent: Dec. 25, 2018

(54) DEVICE TO POSITION SOCKS TO FACILITATE DONNING THE SOCKS ON USER LEGS

(71) Applicant: Rodolfo Bisbal, Miami, FL (US)

(72) Inventor: Rodolfo Bisbal, Miami, FL (US)

( * ) Notice: Subject to any disclaimer, the term of this patent is extended or adjusted under 35 U.S.C. 154(b) by 0 days.

(21) Appl. No.: 16/038,573

(22) Filed: Jul. 18, 2018

(51) Int. Cl.
*A47G 25/90* (2006.01)

(52) U.S. Cl.
CPC ..... *A47G 25/905* (2013.01); *A47G 25/90* (2013.01)

(58) Field of Classification Search
CPC ..... A47G 25/90; A47G 25/905–25/908
See application file for complete search history.

(56) References Cited

U.S. PATENT DOCUMENTS 2,443,115 A * 6/1948 Park ..... A47G 25/905 223/111
2,894,669 A * 7/1959 Silken ..... A47G 25/905 223/111
3,070,271 A * 12/1962 Kennedy, Sr. ..... A47G 25/905 223/111
3,883,052 A * 5/1975 Wilson ..... A47G 25/905 223/111
4,072,255 A * 2/1978 Bogorad ..... A47G 25/905 223/111
4,130,226 A 12/1978 Farrell
4,516,704 A 5/1985 Hagman
9,498,077 B2 * 11/2016 Carlson ..... A47G 25/905
2005/0103812 A1 * 5/2005 Engelman ..... A47G 25/80 223/113
2014/0263486 A1 * 9/2014 Taylor ..... A47G 25/905 223/111

* cited by examiner

*Primary Examiner* — Ismael Izaguirre
(74) *Attorney, Agent, or Firm* — Sanchelima & Associates, P.A.; Christian Sanchelima; Jesus Sanchelima

(57) ABSTRACT

An apparatus for aiding in donning a sock is disclosed. The apparatus comprises a ring like member having an outer circumference, a strip of sandpaper and an angled handle member. The ring like member comprises sufficient diameter to permit a user's foot to fit loosely therein. The strip of sandpaper is disposed around the outer circumference of the ring like member. The angled handle member is detachably attached to the ring like member. The ring like member is configured to engage to an open end of the sock. The sandpaper is configured to grip and hold the sock in position while user donning the sock via the ring like member.

11 Claims, 4 Drawing Sheets

DEVICE TO POSITION SOCKS TO FACILITATE DONNING THE SOCKS ON USER LEGS

BACKGROUND OF THE INVENTION

1. Field of the Invention

The present disclosure relates to a dressing aid. More particularly, the present disclosure relates to an apparatus adapted to aid in donning a sock and the like.

2. Description of the Related Art

Sock is a clothing article worn on the foot as an intermediary layer between bare foot and shoe to provide comfort to the user. While wearing such article of clothing, the user must bend the body until the foot is reached. Although this manoeuvre presents no real problem for those who are physically fit, for others suffering from, for example, arthritis, sciatica, low back pain, spine injury, as well as those who are obese and pregnant women in the later stage of pregnancy, the ability to bend a required extent could be a formidable task. Such individuals must either require assistance from caregivers or other persons for donning the stockings, socks or other related coverings for the foot. The inability of wearing these items without any assistance can have an adverse effect on the user's independence and emotional well-being.

Several devices have been designed in the past. None of them, however, include an apparatus for donning the sock that is capable of addressing the foregoing discussed issues.

Applicant believes that a related reference corresponds to U.S. Pat. No. 4,130,226A filed by Mary S. Farrell describes a garment applying device. The Mary reference teaches a hoop-like device over, which the garment to be put on is placed and then held with a plurality of clamps to the hoop. The device includes a handle which is adjustable in length relative to the hoop so that the device may be used by persons of varying heights and arm reach. However, if the clamp utilized by Mary reference has a relatively smooth surface, the garment could be not held firmly, and may slip out of the device. In another case, if the clamps are provided with a profile to hold the garment firmly, the clamps might leave marks or holes on the garment.

Another related reference is U.S. Pat. No. 4,516,704A filed by Harry C. Hagman for a hosiery donning aid. The Harry reference teaches a simple device for aiding the infirm in donning hosiery. The hosiery donning aid comprises a rigid hoop and a handle. The hoop is of a size sufficiently large to permit it to fit loosely over the foot. The handle is secured to one side of the hoop and permits a sock or stocking held loosely engaged over the outside surface of the hoop to be maneuvered onto the user's foot. However, the Harry reference does not disclose any means to secure the position of hosiery on the device during insertion of the hoop onto the user's foot, which results in slippage of sock from the device.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an apparatus for aiding in donning a sock.

It is another object of the present invention to provide the apparatus comprising a ring like member having an outer circumference configured to engage to an open end of the sock.

It is another object of the present invention to provide the apparatus comprising the ring like member having sufficient diameter to permit a user's foot to fit loosely therein.

It is yet another object of the present invention to provide the apparatus comprising a strip of sandpaper disposed around the outer circumference of the ring like member, which is configured to grip the sock engaged on the ring like member in position.

It is yet another object of the present invention to provide the apparatus comprising an angled handle member detachably attached to the ring like member.

It is yet another object of the present invention to provide the apparatus comprising least one additional ring like member, wherein the additional ring like member having a diameter different than the ring like member.

It is yet another object of the present invention to provide the ring like member that is adapted to interchange with the additional ring like member.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1A:
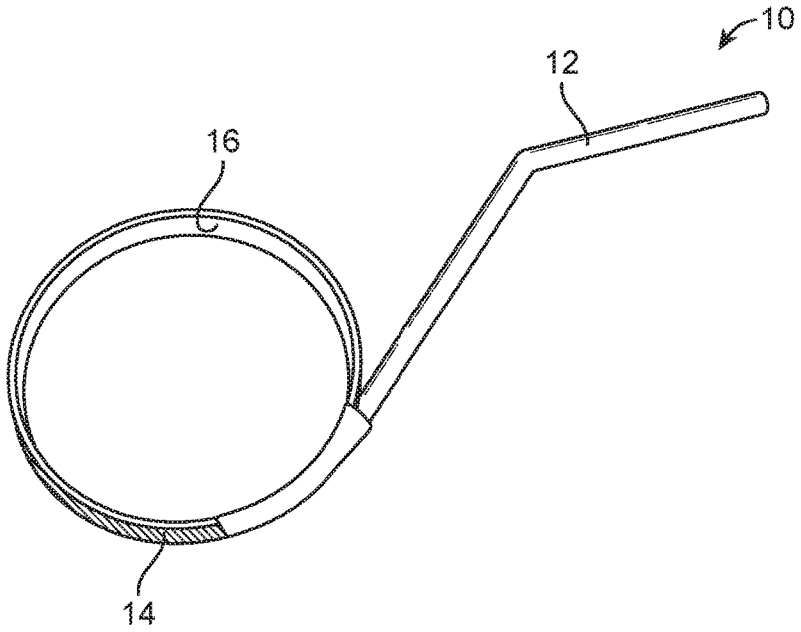
FIG. 1A exemplarily illustrates a perspective view of an apparatus 10 for aiding in donning a sock, according to an embodiment of the present invention. The apparatus 10 comprises a ring like member 16, a strip of sandpaper 14 and an angled handle member 12, is illustrated.
Figure 1B:
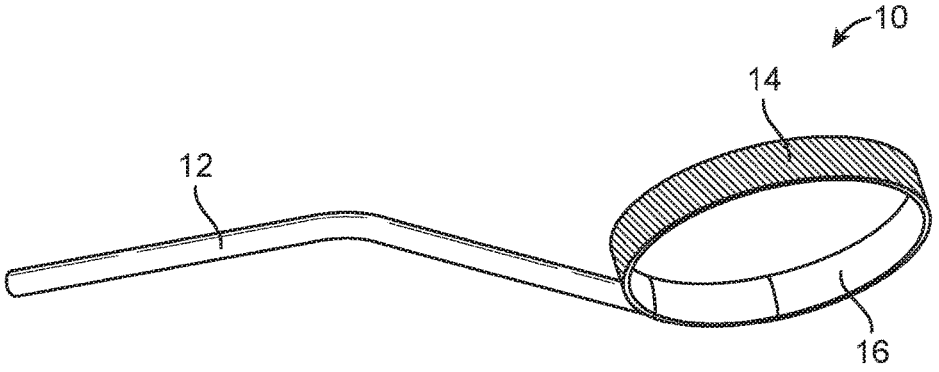
FIG. 1B exemplarily illustrates a side perspective view of the apparatus 10, according to an embodiment of the present invention. The apparatus 10 comprising the ring like member 16, the strip of sandpaper 14 disposed around an outer circumference of the ring like member 16 and the angled handle member 12 attached to the ring like member 16, is illustrated.
Figure 2:
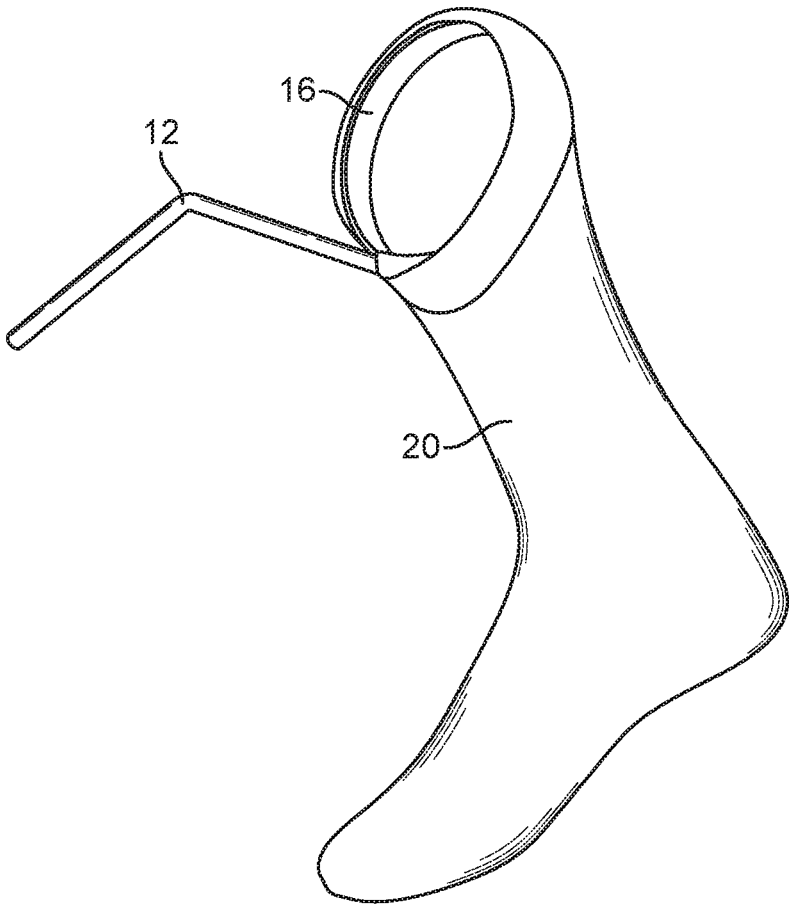
FIG. 2 exemplarily illustrates the apparatus with a sock 20 attached thereto, according to an embodiment of the present invention. An open end of the sock 20 is stretched over the ring like member 16, and the sandpaper 14 holding the sock 20 in position, is illustrated.
Figure 3A:
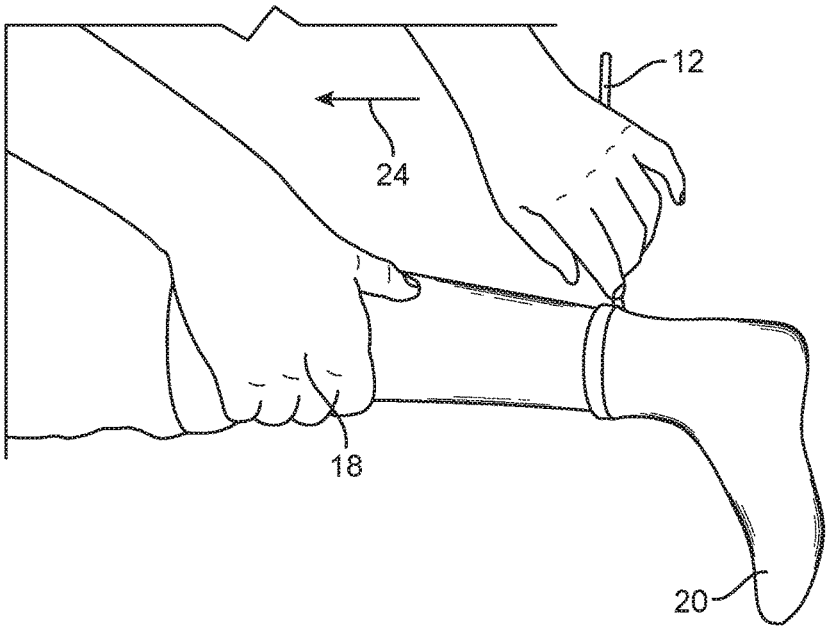
FIG. 3A exemplarily illustrates the apparatus 10 aiding a user 18 in donning the sock 20, according to an embodiment of the present invention. The user 18 inserts his foot into the opening of the sock 20 and lifts the apparatus 10 in an upward direction, represented by arrow 24, to pull the sock into place on his leg, is illustrated.
Figure 3B:
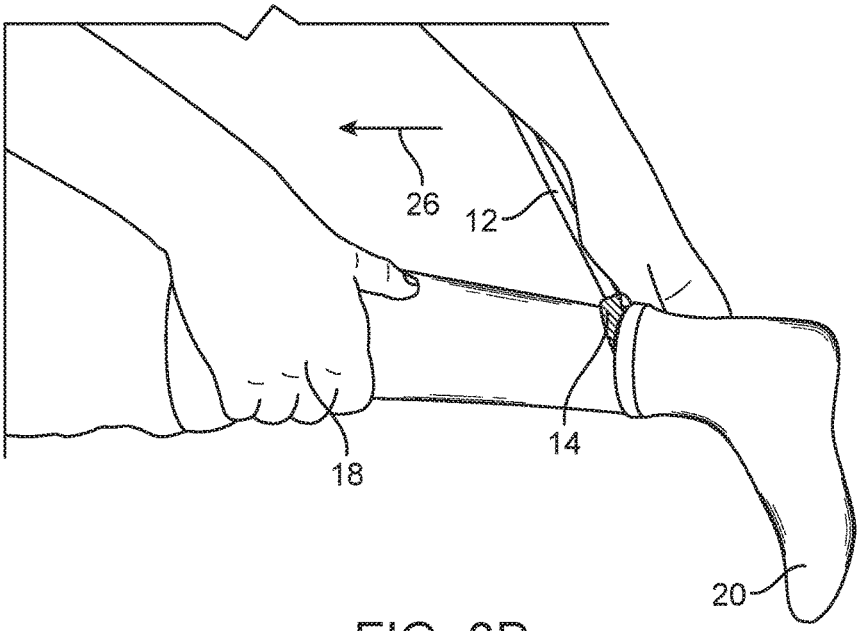
FIG. 3B exemplarily illustrates the ring like member 16 being removed from the open end of the sock 20 by the user 18, according to an embodiment of the present invention. The ring like member 16 is pulled in upward direction, represented by arrow 26, to release the sock 20 from the sandpaper 14, is illustrated.
Figure 3C:
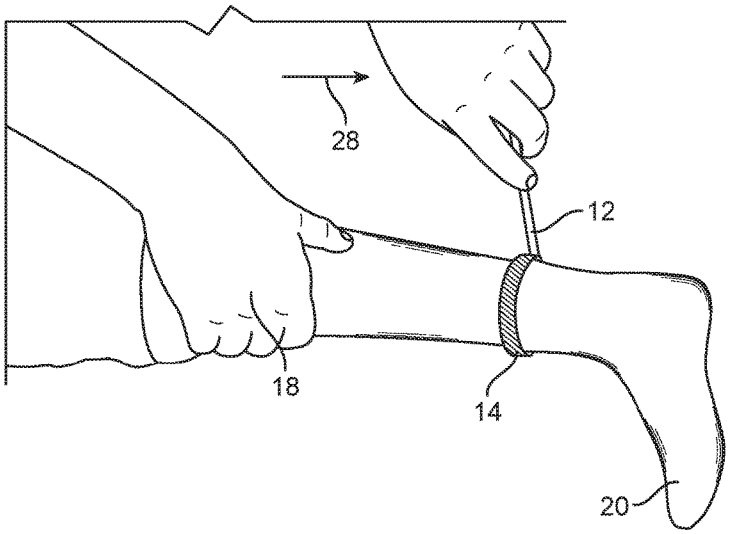
FIG. 3C exemplarily illustrates the ring like member 16 removed from the open end of the sock 20, according to an embodiment of the present invention. The removal of the apparatus 10 from the foot of the user 18 is accomplished by maneuvering the handle member 12 in the downward direction, represented by the arrow 28, is illustrated.
Figure 3D:
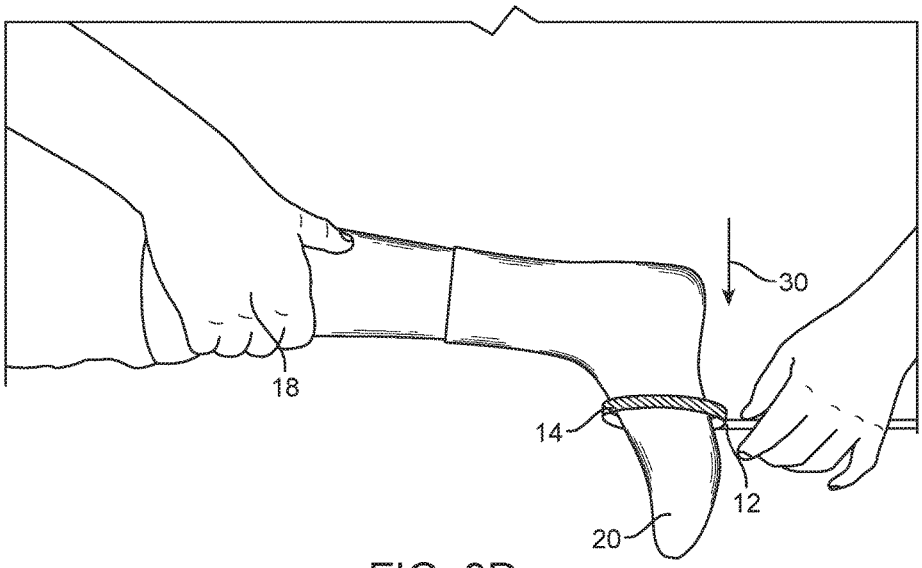
FIG. 3D exemplarily illustrates removal of apparatus 10 from the foot of the user 18, according to an embodiment of the present invention. The ring like member 16 is slid off in a downward direction, represented by arrow 30, through the foot of the user 18, is illustrated.

Referring now to the drawings, FIGS. 1A-3D, where the present invention is generally referred with numeral 10, it can be observed that an apparatus 10 adapted to aid in donning of sock 20 or the like, is disclosed. The apparatus 10 comprises a ring like member 16, a strip of sandpaper 14 and an angled handle member 12. The ring like member 16 having an outer circumference is configured to engage to an open end of the sock 20. The ring like member 16 further comprises sufficient diameter to permit a user's foot to fit loosely therein. Ring like member 16 can be detachable or integral to angled handle member 12. They can be detachably connected using a snap button or push pin with a corresponding opening on the opposite member.

The strip of sandpaper 14 is disposed around the outer circumference of the ring like member 16. The sandpaper 14 is configured to grip and maintain the sock 20 in position. The angled handle member 12 is attached to one side of the ring like member 16. In one embodiment, the handle member 12 is disengageable from the ring like member 16. The device further comprises one or more additional ring like member. In one embodiment, each additional ring like member having a different diameter than said ring like member 16. In one embodiment, the ring-like member 16 is removably mounted to the handle member 20, so that a user 18 could interchangeably mount other additional ring like members of different diameter.

In one embodiment, the handle member 12 and the ring like member 16 is made of metal, plastic, or any other rigid material. In one embodiment, the ring like member 16 is circular in shape. In another embodiment, the ring like member 16 comprises a suitable shape and diameter to permit a user's foot to fit loosely therein. During use of the apparatus 10, the sock 20 or the like is attached to the ring like member 16. The apparatus 10 is turned to an upright position and placed before the foot of the user 18. The user 18 then inserts his foot into the opening of the sock 20 and lifts the apparatus 10 upwards to pull the sock 20 into place on his foot. When the sock 20 is in desired place, the user 18 could release the apparatus 10 from the sock 20. Then, the ring like member 16 is slid off the foot and out of the remaining portion of the sock 20 so that the user 18 could finish donning the sock 20 up his or her leg.

Advantageously, the apparatus 10 allows the user 18 to autonomously operate, without requiring the user 18 to bend his back or body, or without requiring the user 18 to apply force on his back, spinal cord or spine. Further, the apparatus 10 is advantageous to the user 18 who is, for example, sick, disabled or tired. The apparatus 10 provides a comfort solution for the user 18 who has limited movement to put on the sock 20 without assistance.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for aiding in donning a sock, comprising:
a ring like member having an outer circumference;
a strip of sandpaper disposed around the outer circumference of the ring like member, and
an angled handle member attached to the ring like member having a first segment tangent to the plane of the ring like member.

2. The apparatus of claim 1, wherein the ring like member comprises sufficient diameter to permit a user's foot to fit loosely therein.

3. The apparatus of claim 1, wherein the ring like member configured to engage to an open end of the sock.

4. The apparatus of claim 1, wherein the sandpaper configured to grip the sock engaged on the ring like member in position.

5. The apparatus of claim 1, wherein the ring like member and handle is made of rigid material.

6. The apparatus of claim 1, wherein the ring like member is of circular shape.

7. The apparatus of claim 1, wherein the ring like member is disengageable from the handle.

8. The apparatus of claim 1, further comprising at least one additional ring like member.

9. The apparatus of claim 1, wherein said additional ring like member having a diameter different than said ring like member.

10. The apparatus of claim 1, wherein the ring like member is adapted to interchange with the additional ring like member.

11. The apparatus of claim 1 wherein said angled handle includes a second segment, said first segment mounted to said second segment in an obtuse angle relationship.

* * * * *